US007228978B2

(12) United States Patent
Cross

(10) Patent No.: US 7,228,978 B2
(45) Date of Patent: Jun. 12, 2007

(54) STORAGE SURFACE ASSEMBLY

(76) Inventor: David J. Cross, c/o Border Crossing, 413 Interamerica Blvd., Suite 1, Bc 23-23, Laredo, TX (US) 78045

( * ) Notice: Subject to any disclaimer, the term of this patent is extended or adjusted under 35 U.S.C. 154(b) by 169 days.

(21) Appl. No.: 10/460,309

(22) Filed: Jun. 13, 2003

(65) Prior Publication Data

US 2004/0251225 A1 Dec. 16, 2004

(51) Int. Cl.
*A47F 5/08* (2006.01)

(52) U.S. Cl. ..... 211/153

(58) Field of Classification Search ..... 211/153, 211/135; 108/157.1, 153.1, 144.11, 106
See application file for complete search history.

(56) References Cited

U.S. PATENT DOCUMENTS 3,556,309 A * 1/1971 Schreyer et al. ..... 211/153
3,643,607 A * 2/1972 MacKenzie ..... 108/180
3,724,078 A * 4/1973 Carlin et al. ..... 52/177
3,986,462 A * 10/1976 Heft ..... 108/188
4,995,323 A * 2/1991 Kellems et al. ..... 108/157.13
5,199,582 A * 4/1993 Halstrick ..... 211/135
5,279,431 A 1/1994 Highsmith et al. ..... 211/189
5,628,415 A 5/1997 Mulholland ..... 211/189
6,050,428 A * 4/2000 Hollander ..... 211/186
6,401,944 B1 * 6/2002 Kircher et al. ..... 211/134

* cited by examiner

*Primary Examiner*—Sarah Purol
(74) *Attorney, Agent, or Firm*—Ked & Associates, LLP

(57) ABSTRACT

A storage surface assembly is provided for use as a shelf for holding storage items. This storage surface assembly is well suited for use in many industrial and/or commercial applications, where storage shelves must bear heavy loads and maintain their structural integrity while complying with fire codes requiring some amount of open area along the surface of the shelf. Therefore, there is provided a storage surface assembly for use in a standard commercial racking assembly, the storage surface assembly comprising a pair of extension members, and a plurality of traverse members extending between the pair of extension members, wherein the traverse members can be attached to the extension members by various methods, based on the requirements dictated by a particular storage environment.

64 Claims, 19 Drawing Sheets

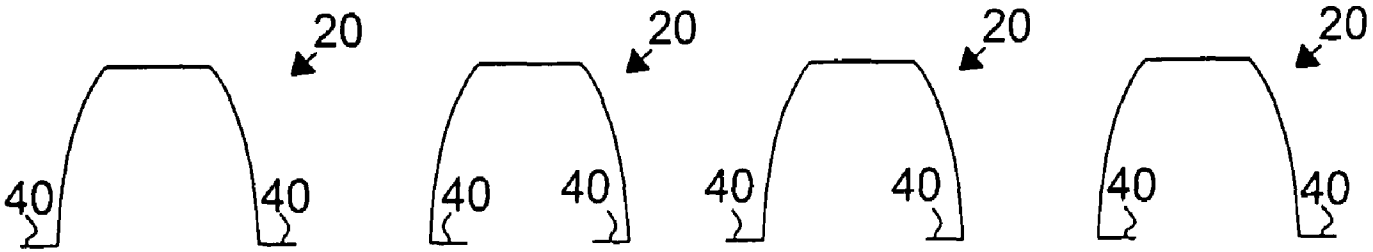
FIG. 4I
FIG. 4J
FIG. 4K
FIG. 4L
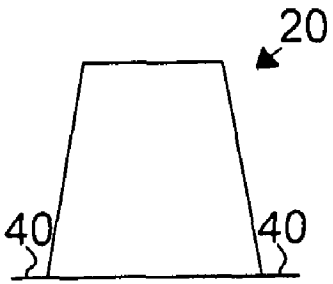
FIG. 4M

STORAGE SURFACE ASSEMBLY

BACKGROUND OF THE INVENTION

1. Field of the Invention

This invention relates to a storage surface assembly for use as a shelf for holding storage items in industrial/commercial applications/environments.

2. Background of the Related Art

Storage shelves used in an industrial/commercial environment must often beat heavy loads while still maintaining their structural integrity, as well as resist the twisting and buckling forces generated when storage items are loaded, unloaded, or moved. These industrial storage shelves are also subjected to fire codes requiring some amount of "open area" along the surface of the shelf, dictated in most cases by the particular environment in which they will be used, as well as the types of items to be stored.

The "open area" required by fire codes is typically 50% of the surface area of the shelf. This open area requirement was imposed to allow a fire in the storage area to be more efficiently contained and extinguished, thus minimizing damage to storage items. More specifically, a shelf with an adequate amount of open area allows a fire initiated on a lower shelf to move vertically up the storage rack, towards the sprinkler, allowing heat to dissipate more quickly and activating the sprinklers before the fire has gained significant intensity. Closed shelves (shelves with little to no open area), which may provide adequate load capacity and structural integrity, would, on the other hand, form an enclosed space between shelves, allowing a fire to build in intensity in that enclosed space, spread horizontally to a neighboring rack of shelves, and also delay deployment of the sprinkler system, rendering the sprinkler system significantly less effective in containing and extinguishing the fire. This 50% open area requirement poses a unique challenge in providing shelves with adequate structural integrity at a reasonable cost, while still meeting this open area requirement. Current solutions, such as those discussed below, are not adequate.

Slatted wooden decking, although easily and inexpensively manufactured, has significant disadvantages in that it is less durable and more susceptible to deformation than steel, and more likely to break under continued loading or changing environmental conditions. Its most significant disadvantage is that it is highly flammable.

Wire mesh decking is a commonly used shelving solution in industrial/commercial applications. Wire mesh meets the 50% open area requirement, but, as wire mesh is simply laid across a series of cross bars, it remains unsupported across a majority of its load-bearing surface, and thus deforms easily. Further, if one of the support bars is damaged, it cannot be repaired or replaced without removal of the entire wire mesh, most likely resulting in replacement of the entire deck as repair would not be cost effective. Additionally, due to the nature of the surface of wire mesh, especially after it has deformed, it is difficult to load/unload/move storage items without damaging the storage items and/or the wire mesh, as the mesh tends to catch on the storage items, producing rips, punctures, or impressions. Wire mesh decks are not easily manufactured or shipped, making them a more costly, less efficient shelving solution.

U.S. Pat. No. 5,279,431 to Highsmith et al. discloses a storage rack with storages surfaces formed by crossbars with tangs extending from the ends which are then inserted into corresponding slots in the side beams. However, Highsmith's design is complicated, difficult and costly to manufacture, and the shelving system must be used with Highsmith's racking system and cannot be readily adapted for use in other racking systems. Further, as the bulk of the load on the storage surface is carried by a very small tang at the end of the crossbar, Highsmith's design cannot be used in commercial/industrial applications, where shelves must beat heavy loads while maintaining their structural integrity.

Likewise, U.S. Pat. No. 5,628,415 to Mulholland also discloses a storage rack with safety bars fitted to support beams by mating tabs and slots. Mulholland's design is complicated, difficult and costly to manufacture, and is for an entire racking system whose shelves cannot be readily adapted for use with other racking systems.

U.S. Pat. No. 5,199,582 to Halstrick discloses a storage rack which uses a corrugated plate to form each shelf Although Halstrick's design incorporates holes in the corrugated sheet to allow for a very limited amount of open area, this design could not meet the 50% open area requirement with out affecting the structural integrity of the shelf.

U.S. Pat. No. 6,401,944 to Kircher et al. discloses a storage rack similar to Halstrick's which does meet the 50% open area requirement. However, there are several disadvantages associated with Kircher's design. Kircher's corrugated deck is expensive to manufacture and ship, increasing cost to the user. If not properly secured in the rack, the deck elements can spread over time due to the load applied by the storage items, forcing the rack to carry more that its design load, thereby compromising the rack's structural integrity. Similar to wire mesh, the holes, unless properly finished, tend to shred storage items when they are loaded, unloaded and moved.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

According to the invention, therefore there is provided a storage surface assembly for use as a shelf for holding storage items in industrial or commercial environments. Some amount of the surface area of the storage surface assembly remains open in order to provide for adequate circulation of air, heat dissipation, and water flow, and meet current fire code requirements. The open area of the storage surface assembly would typically be at least 50% in order to comply with current fire codes. However, as will become apparent in the discussion that follows, the storage surface assembly may be adjusted to meet a variety of open area requirements, and is not limited to a 50% open area.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
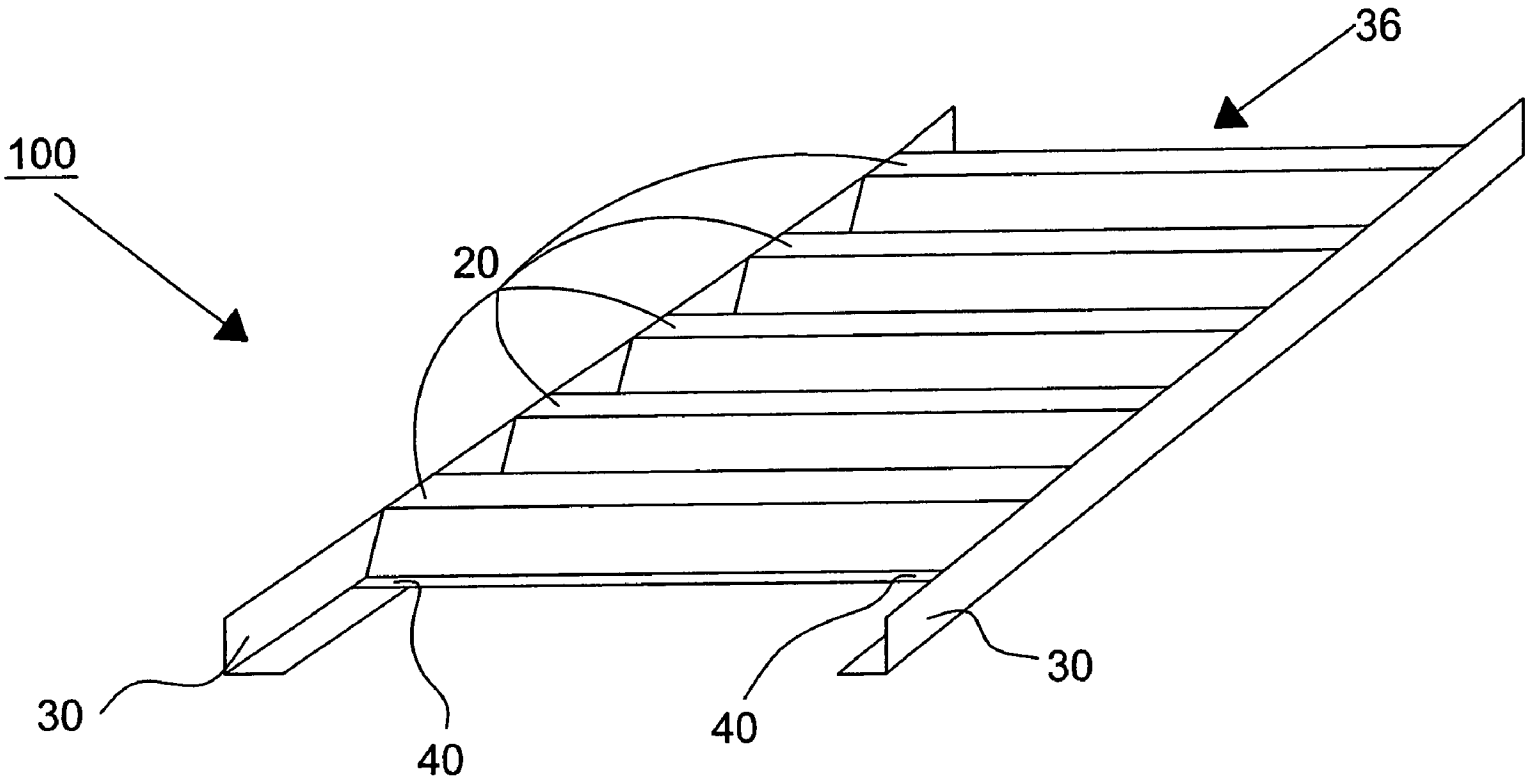
FIG. 1 is a perspective view of a storage surface assembly according to an embodiment of the invention.
Figure 5:
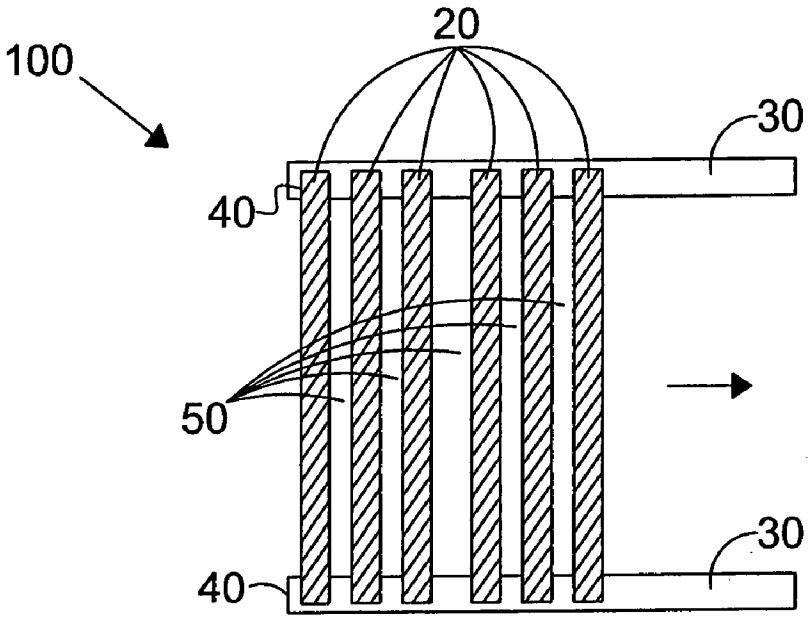
FIG. 5 is a top view of a storage surface assembly according to an embodiment of the invention.

FIG. 1 is a perspective view of a storage surface assembly according to an embodiment of the invention. The storage surface assembly 100 of FIG. 1 is constructed of a plurality of traverse members 20 attached to extension members 30 at attachment members 40 to form a surface area 36. As shown in FIG. 5, at least a portion of the traverse members 20 are spaced apart from one another to form open spaces 50. In order to meet current fire code requirements and in order to provide for adequate circulation of air, heat dissipation, and water flow, at least 50% of the surface area 36 remains open via the open spaces 50 formed between the traverse members 20.

It is well understood by one skilled in the art that the amount of surface area 36 that remains open can be either increased or decreased based on the number of traverse members 20 attached to a particular pair of extension members 30, as well as the positioning of the traverse members 20 along the extension members 30. In this manner, the storage surface assembly 100 can be adapted to meet a variety of open area requirements.

In the embodiment of FIG. 1, the extension members 30 comprise angle irons; however, other shapes and materials may also be appropriate. The number of traverse members 20 used in the construction of the storage surface assembly 100 can be adjusted to suit, for example, the size and load bearing capability required for a particular application. However, the open air space must remain at least 50% for the above described reasons.

Figures 2A, 2B:
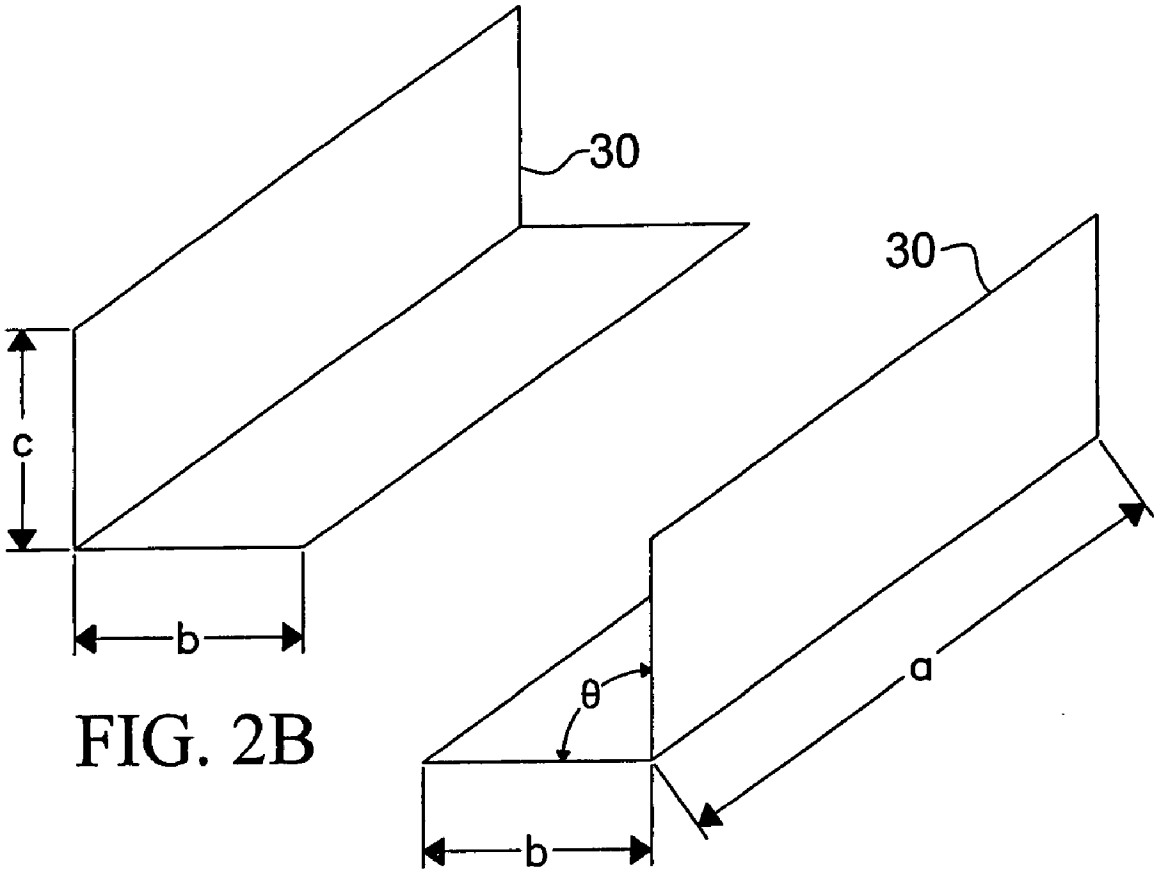
FIGS. 2A–2B are perspective views of extension members employable in a storage surface assembly according to an embodiment of the invention.
Figure 2C:
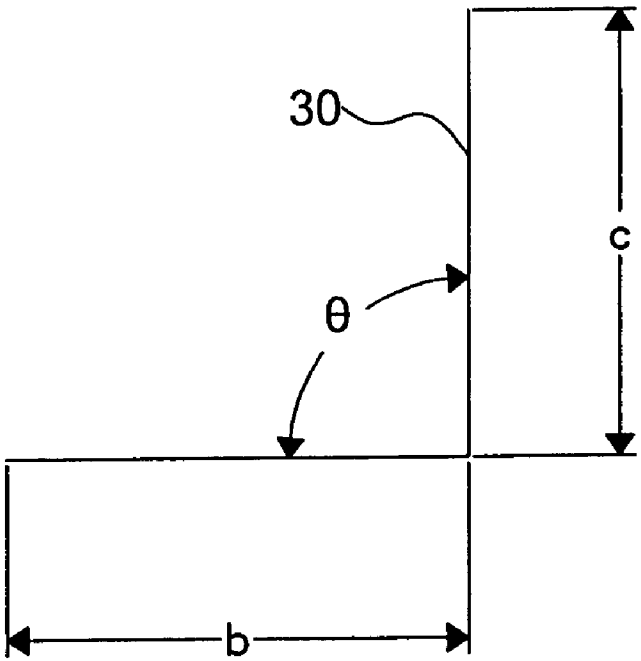
FIG. 2C is a cross sectional view of the extension members of FIGS. 2A–2B.

FIGS. 2A–2B are perspective views and FIG. 2C is a cross sectional view of an extension member 30 employable in a storage surface assembly in accordance with an embodiment of the invention. The extension members 30 of the embodiment of FIGS. 2A–2C comprise angle irons forming an angle θ of 90 degrees; however, other angles may also be appropriate, depending on the particular application. Likewise, the length a, width b and height c of the extension member 30 can be varied as necessary, depending, for example, on a particular application's size and load bearing requirements.

Figure 3A:
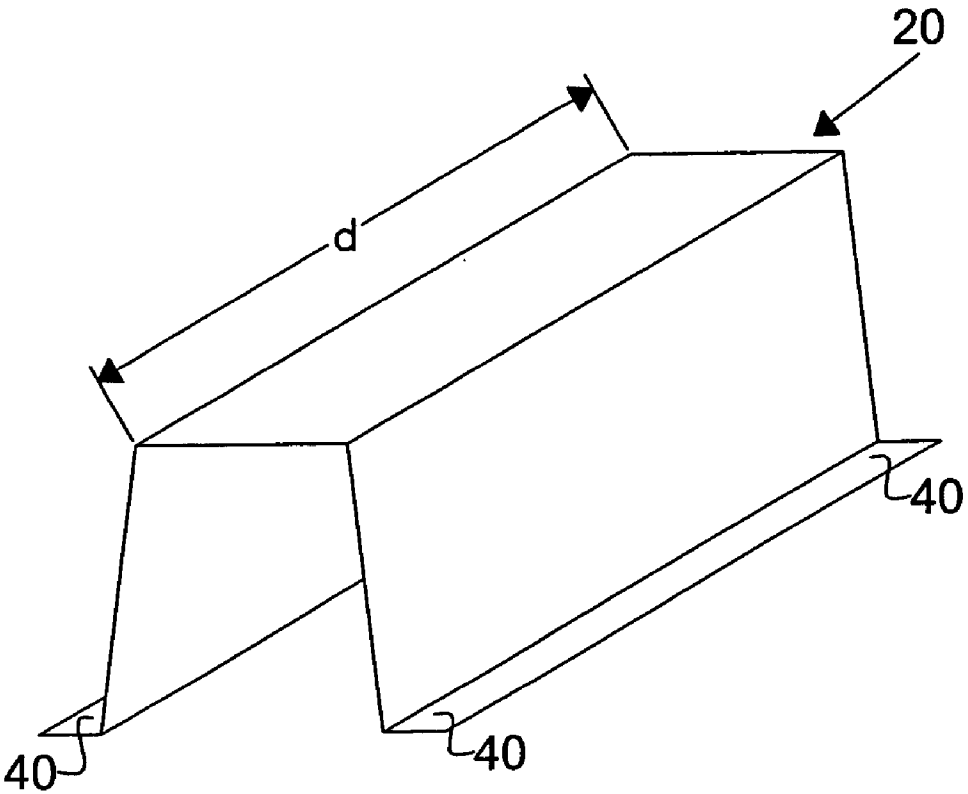
FIG. 3A is a perspective view of a traverse member employable in a storage surface assembly according to an embodiment of the invention.
Figure 3B:
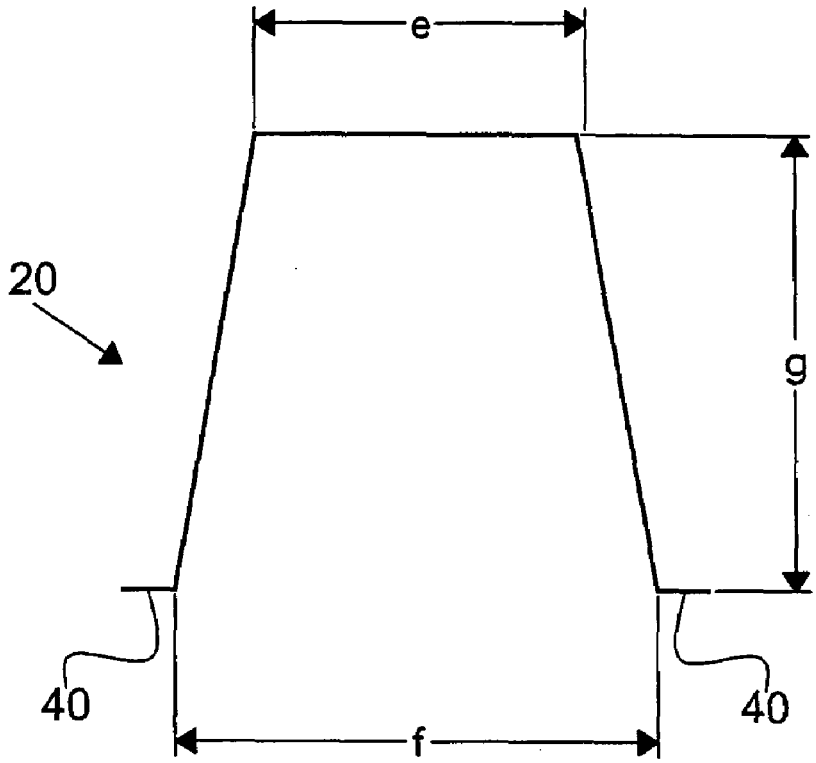
FIG. 3B is a cross sectional view of the traverse member of FIG. 3A.
Figure 4A:
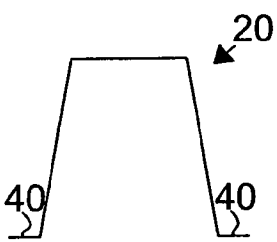
FIGS. 4A–4N and 4P–4R are cross sectional views of alternatively shaped traverse members according to embodiments of the invention.
Figure 4B:
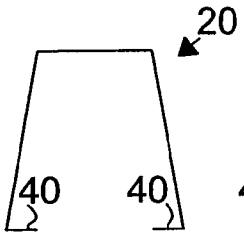
Figure 4C:
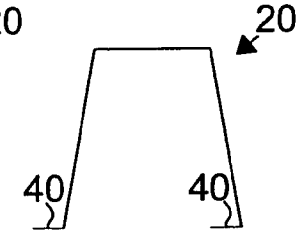
Figure 4D:
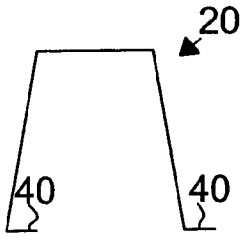
Figure 4E:
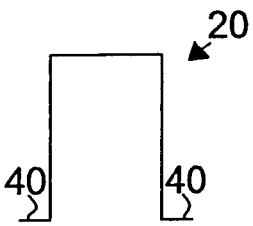
Figure 4F:
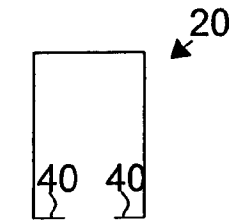
Figure 4G:
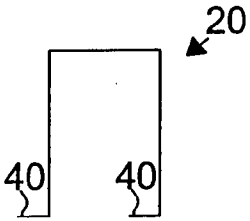
Figure 4H:
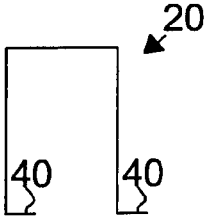
Figures 4N, 4P, 4Q, 4R:
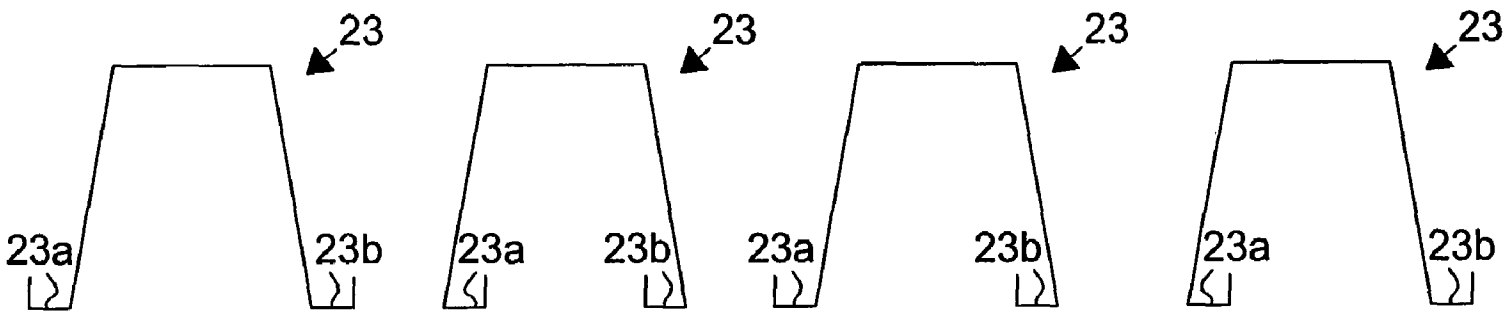

FIG. 3A is a perspective view and FIG. 3B is a cross sectional view of a traverse member 20 employable in a storage surface assembly in accordance with an embodiment of the invention. The traverse member 20 shown in FIGS. 3A–3B are formed in a ⌐⌐ shape, with a bottom width f larger than a top width e; however, the length d, top width e, bottom width f, and height g can be varied as necessary, depending on, for example, a particular application's size and load bearing requirements. Likewise, a number of different cross sectional shapes, such as those shown in FIGS. 4A–4R, may also be appropriate for the traverse members 20.

As shown in FIG. 5, the traverse members 20 are attached to the extension members 30 at attachment members 40. The attachment members 40 serve to both fix the traverse members 20 in position along the extension members 30, and also to inhibit spreading of the traverse members 20 due to the load applied by a storage item and subsequent loss of load bearing capability. The traverse members 20 which are used in fabricating a single storage surface assembly must not necessarily be of the same cross sectional shape, and traverse members 20 of different cross sectional shapes, such as, for example, combinations of those shown in FIGS. 4A–4R, may be combined to form a single storage surface assembly.

The traverse members 20 and extension members 30 can be made of a variety of different materials. Fabrication material may be selected based on, for example, load bearing requirements and the operating environment for a particular application, as well as cost. For example, in a storage application where humidity and environmental degradation are factors, both the traverse members 20 and extension members 30 may be made of a galvanized steel to inhibit material breakdown due to the environmental factors and subsequent loss of structural integrity. Likewise, in a storage application where cleanliness and appearance are factors, such as in a commercial kitchen, both the traverse members 20 and extension members 30 may be made of a stainless steel. Other materials may also be appropriate. Traverse members 20 and extension members 30 may not necessarily be fabricated from the same material. However, attachment methods and environmental effects should be considered when selecting dissimilar materials for the traverse members 20 and extension members 30.

In certain embodiments, the attachment members 40 may extend outward from the main body of the traverse member 20, such as those shown in, for example, the embodiments of FIGS. 4A, 4E, 4I and 4M, and the traverse member 20 is attached to the extension member 30 at the attachment member 40. In other embodiments, the attachment members 40 may extend inward from an outer surface of the traverse member 20 towards an inner center of the main body of the traverse member 20, such as those shown in, for example, the embodiments of FIGS. 4B, 4F and 4J. In still other embodiments, one attachment member 40 may extend outward from the main body of the traverse member 20, while the other attachment member 40 extends inward, such as those shown in, for example, the embodiments of FIGS. 4C–4D, 4G–4H, and 4K–4L.

There are numerous ways to effectively attach the traverse members 20 to the extension members 30. Some of the methods of attachment well known to those skilled in the art can include, but are not limited to, welds, screws, rivets, and the like. Attachment of the traverse members 20 to the extension members 30 to form a storage surface assembly is not necessarily limited to a single method of attachment within a single storage surface assembly. A combination of attachment methods may be used in assembling a single storage surface assembly, based on the requirements dictated by a particular application.

Additionally, with any of the above attachment methods, individual traverse members 20 can be removed from the extension members 30 and replaced with new/repaired traverse members 20 without complete disassembly of the storage surface assembly 100 or replacement of all traverse members 20 while still maintaining the 50% open area. This allows for cost effective repair of the storage surface assembly 100, and a potentially longer term of use than related art systems.

Figure 2D:
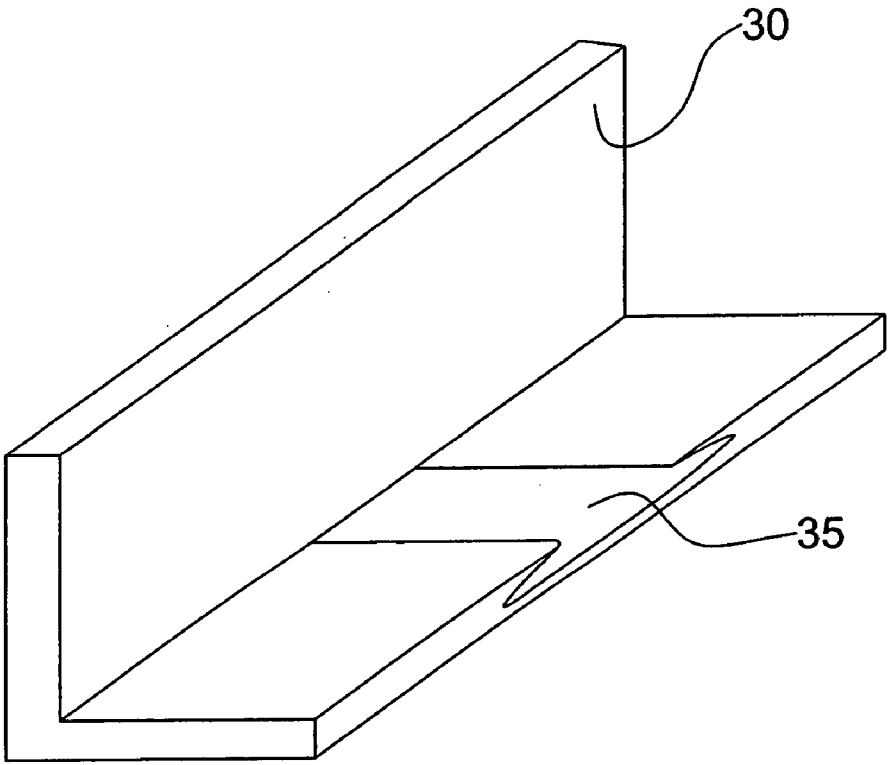
FIG. 2D is a perspective view of an alternative extension member according to an embodiment of the invention.

In yet another embodiment, the extension members 30 are formed as shown in FIG. 2D with a recess 35 which is designed to mate with an end of the traverse member 20 and allow for slidable assembly of the traverse member 20 into the recess 35 of the extension member 30. In this manner, movement of the traverse member 20 along the extension member 30, as well as spreading of the traverse member 20 due to a load applied by a storage item is prevented by the sides of the recesses 35 rather than by the attachment member 40.

Figure 2E:
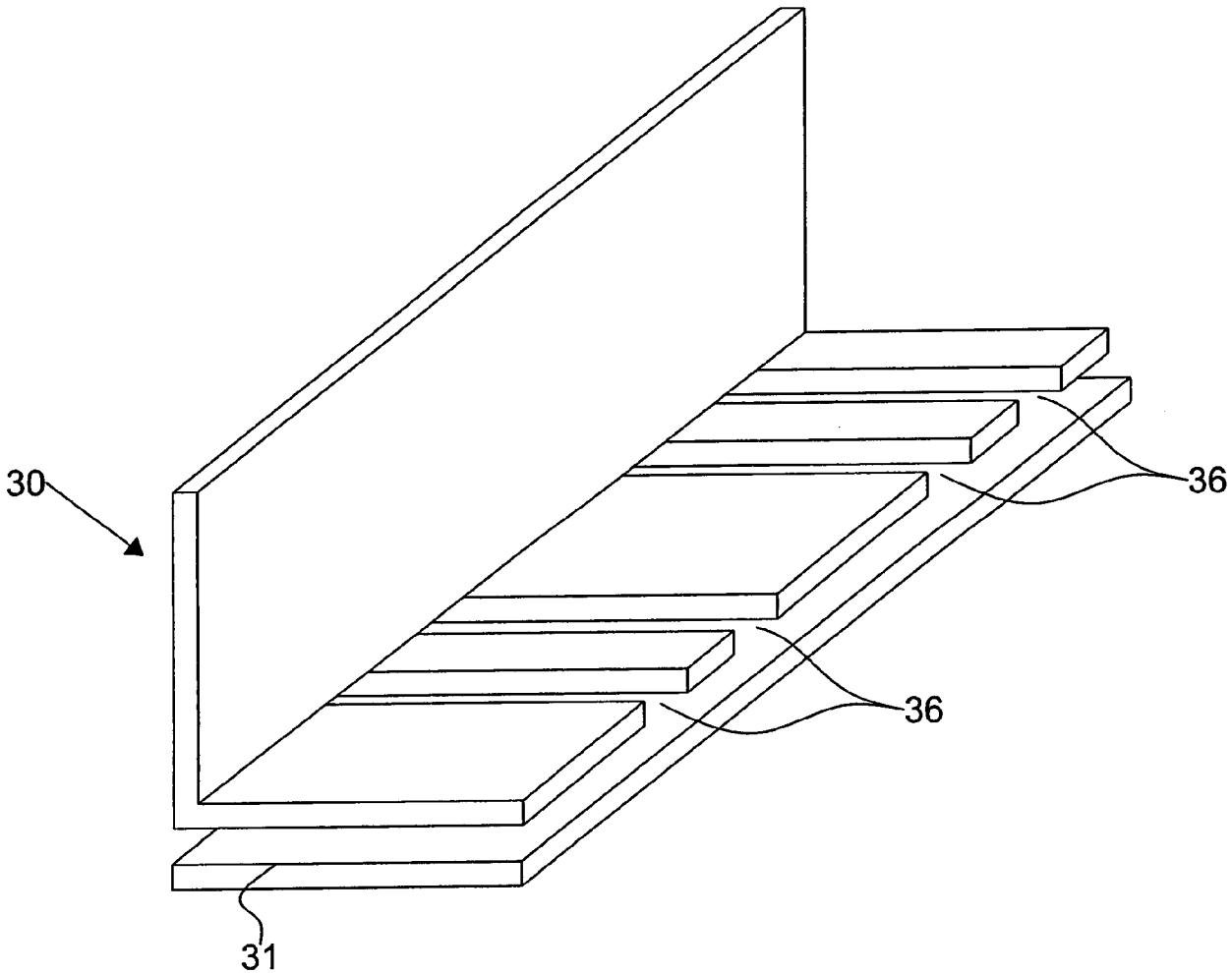
FIG. 2E is a perspective view of another alternative extension member according to an embodiment of the invention.
Figure 2F:
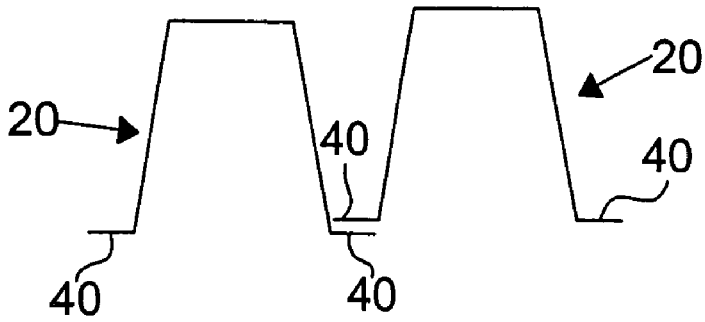
FIGS. 2F–2H are cross sectional views of stacked traverse members according to embodiments of the invention.
Figure 2G:
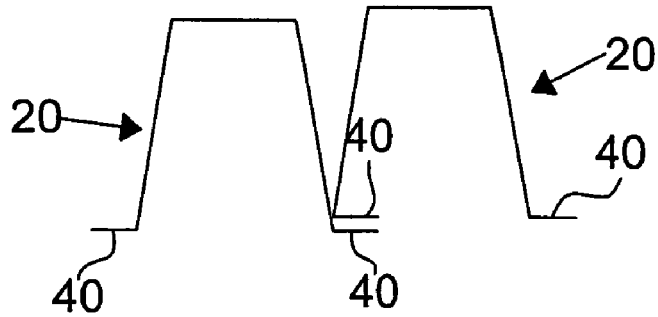
Figure 2H:
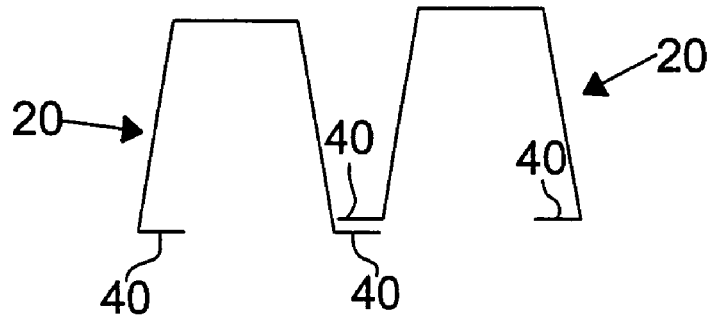

The extension member 30 can also be formed as shown in FIG. 2E, with slots 36 positioned along a horizontal portion of the extension member 30 and corresponding to the attachment members 40 of the traverse member 30, allowing for slidable assembly of a single traverse member 20 such as those shown in, for example, FIGS. 4A–4M, into the slots 36 of the extension member 30, or a "stack" of traverse members as shown in, for example, FIGS. 2F–2H, and discussed below. A flat plate 31 is then attached to a bottom surface of the extension member 30, with the attachment members 40 positioned therebetween, thus securing the traverse members 20 in place.

The spacing of the slots 36 along the horizontal portion of the extension member 30 may be adapted to meet the requirements of a number of different storage applications, and the slots 36 need not be equally spaced. Additionally, as shown in FIGS. 2F–2H, the attachment member 40 of a first traverse member 20 can be placed on and aligned with an attachment member 40 of a second traverse member 20, forming a "stack" of attachment members 40. The stacked attachment members 40 of the first and second traverse members 20 can then be slidably inserted into the slots 36. Stacked traverse members 20 need not necessarily have the same cross sectional shape or attachment member 40 orientation. For example, the traverse member 20 shown in FIG. 4A can be stacked with any of the traverse members 20 shown in FIGS. 4B–4M and then slidably inserted into slot 36. Likewise, the traverse member 20 shown in FIG. 4B can be stacked with any of the traverse members 20 shown in FIGS. 4A, 4C–4E, 4G–4I, and 4K–4M, and so on.

Both the single and the stacked slidable attachment methods discussed above may be employed with a variety of different traverse member 20 combinations, and traverse members 20 need not all be of the same shape in a single storage surface assembly.

Figure 2I:
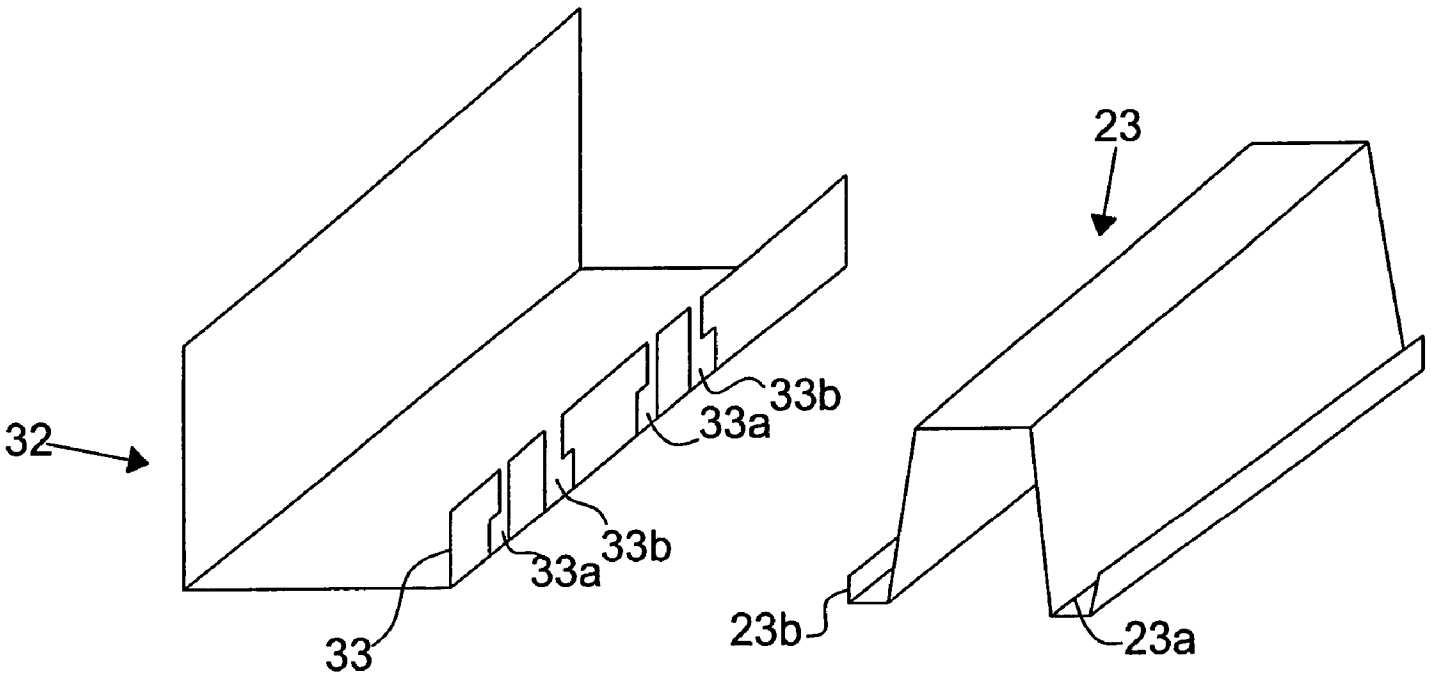
FIGS. 2I–2L are perspective views of alternative extension members and alternative traverse members according to embodiments of the invention.
Figure 2J:
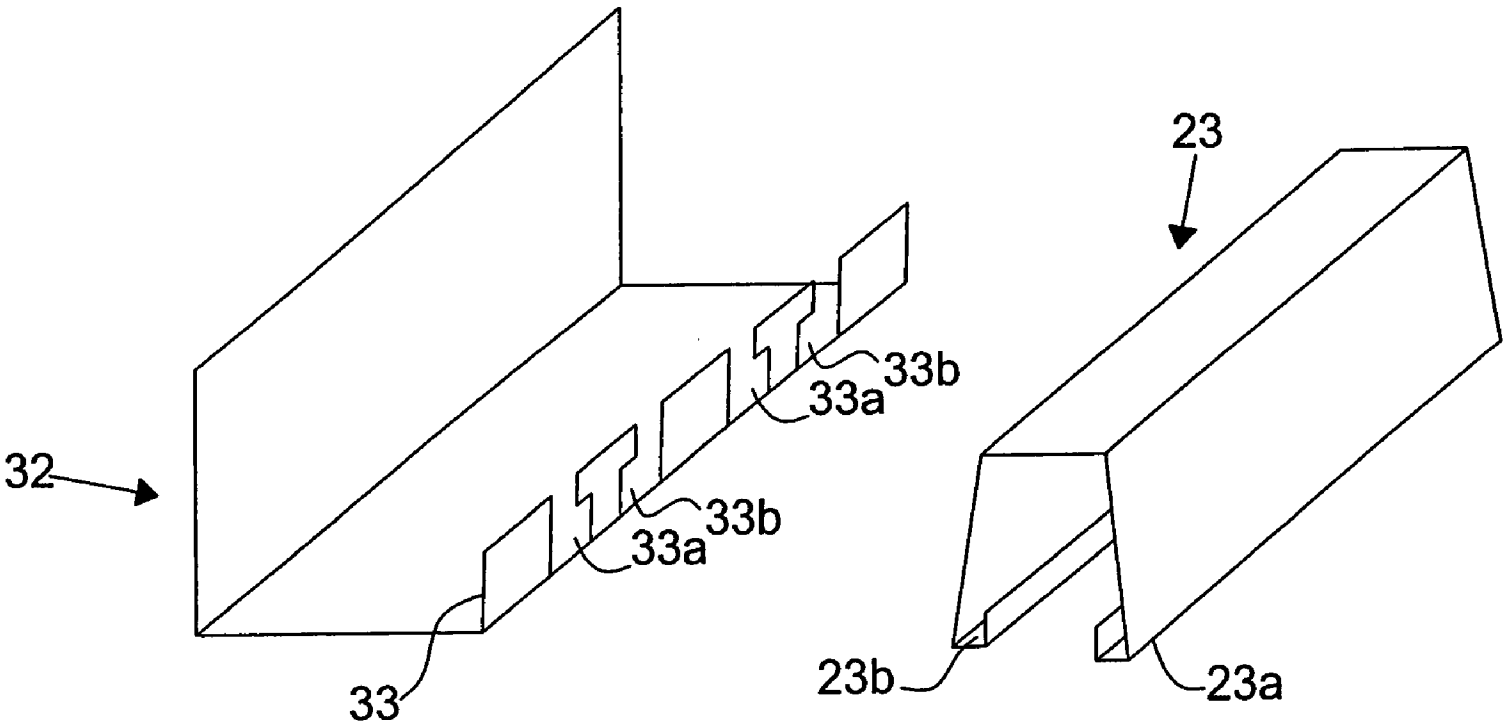
Figure 2K:
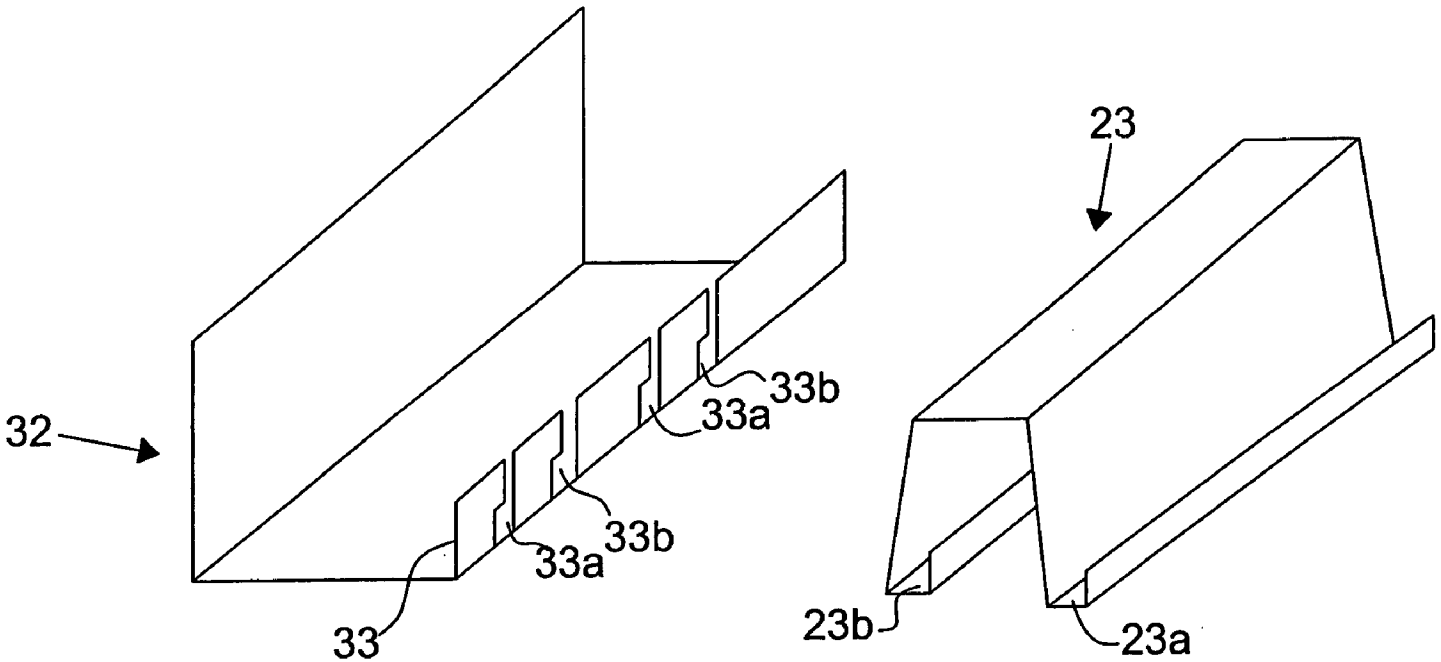
Figure 2L:
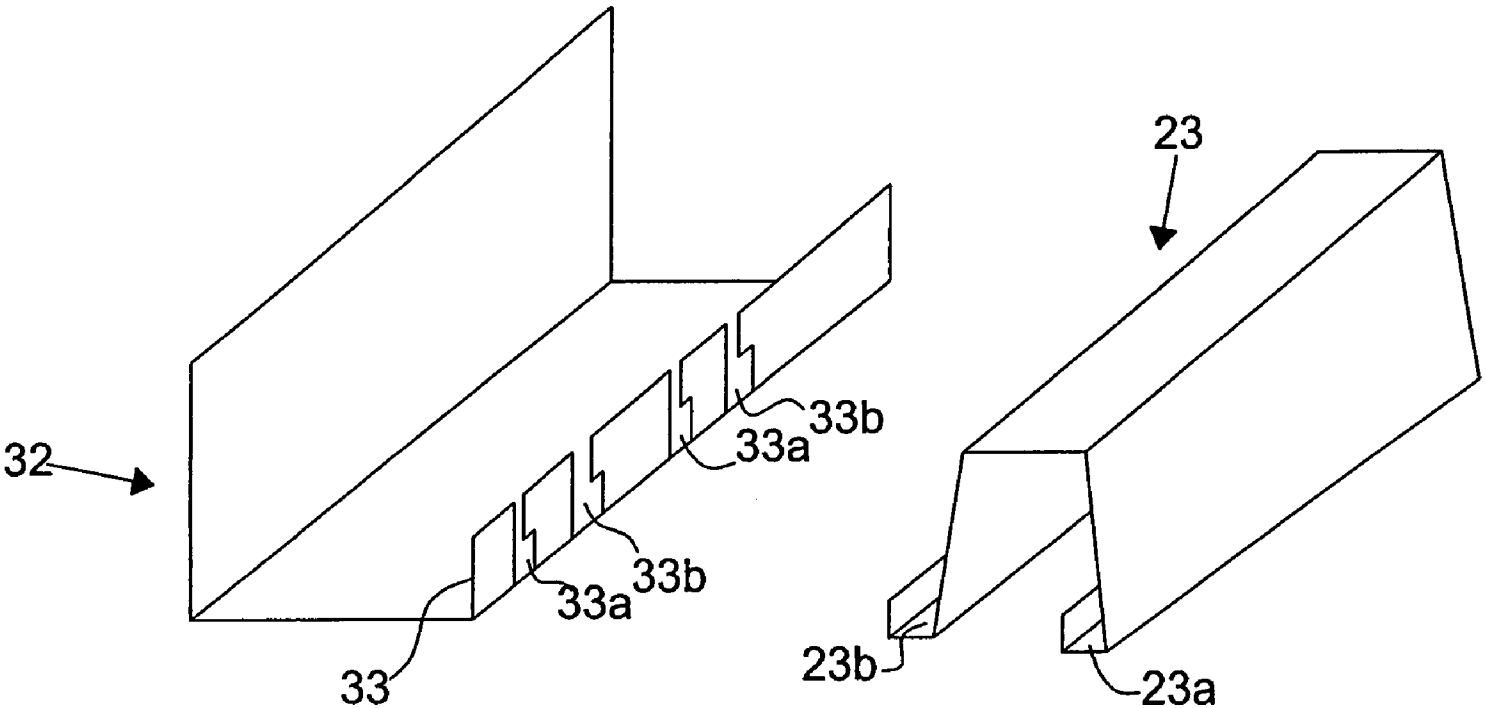

A snap fit procedure could also be employed in attaching traverse members to extension members, as shown in FIGS. 2I–2L. FIG. 2I shows a snap fit extension member 32 with a vertical extension 33 formed along its length, and notches 33*a* and 33*b* corresponding to the cross sectional shape of attachment members 23*a* and 23*b* of a snap fit traverse member 23 cut into the vertical extension 33 at predetermined positions along the length of the snap fit extension member 32. When attachment members 23*a* and 23*b* are aligned with notches 33*a* and 33*b*, a downward force applied to the snap fit traverse member 23 would cause the attachment members 23*a* and 23*b* to temporarily contract as they pass through the more narrow portion of the notches 33*a* and 33*b*, and return to their original shape once they enter the wider portion of the notches 33*a* and 33*b*, thus securing the snap fit traverse member 23 to the snap fit extension member 32. A similar procedure would be used to snap fit the snap fit traverse member 23 to the snap fit extension member 32 shown in FIGS. 2J–2L. Other means of attaching the traverse members to the extension member may also be appropriate based on the application, materials used, and other factors which may effect the assembly's performance.

Figure 6B:
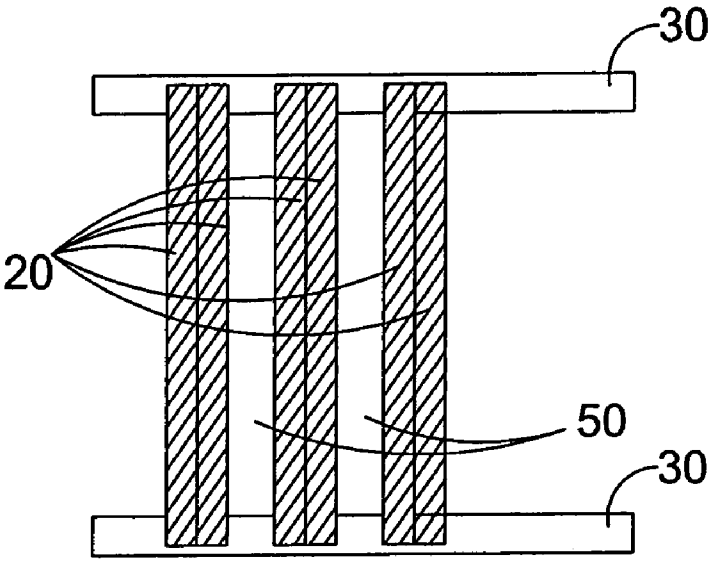
FIGS. 6A–6B are top views of a storage surface assembly according to an embodiment of the invention showing alternate grouping configurations of traverse members.
Figure 6A:
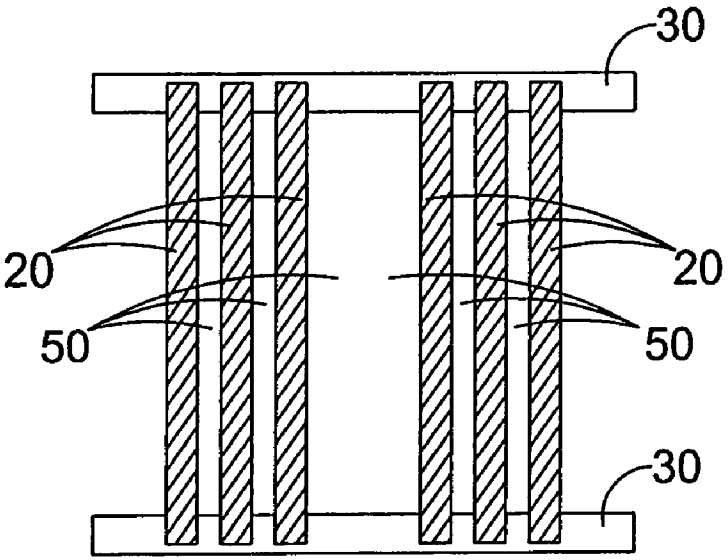

FIG. 5 is a top view of a storage surface assembly according to an embodiment of the invention. The storage surface assembly of FIG. 5 includes a plurality of traverse members 20 extending between two extension members 30. The traverse members 20 are spaced apart from one another forming open spaces 50. In FIG. 5, the traverse members 20 are shown substantially equally spaced along the extension members 30. However, the amount of open space 50 between traverse members 20 may be varied as shown in FIGS. 6A–6B, and various traverse member 20/open area 50 spacing combinations may be appropriate, based, for example, on the desired configuration and/or application. For example, the traverse members 20 may be grouped, as in the embodiment of FIG. 6B, with the open space 50 between groups in these alternative configurations adjusted to conform to the open area requirement as necessary. In this manner, the grouping and spacing of traverse members 20 along the extension members 30 may be adjusted to meet individual user requirements without redesign of the base components of the storage surface assembly 100.

Figure 7:
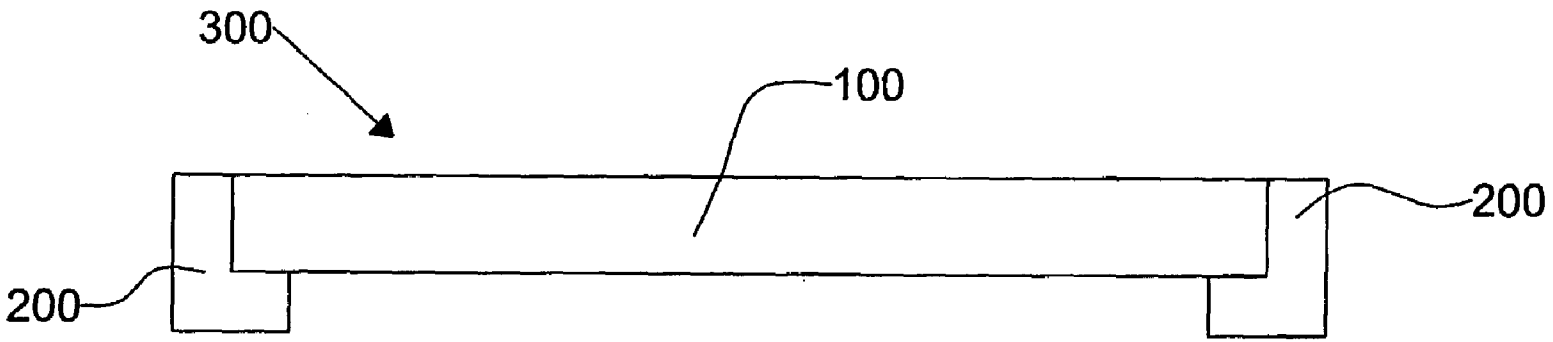
FIG. 7 is a front view of a rack beam assembly according to an embodiment of the invention incorporating a storage surface assembly according to the invention.
Figure 8:
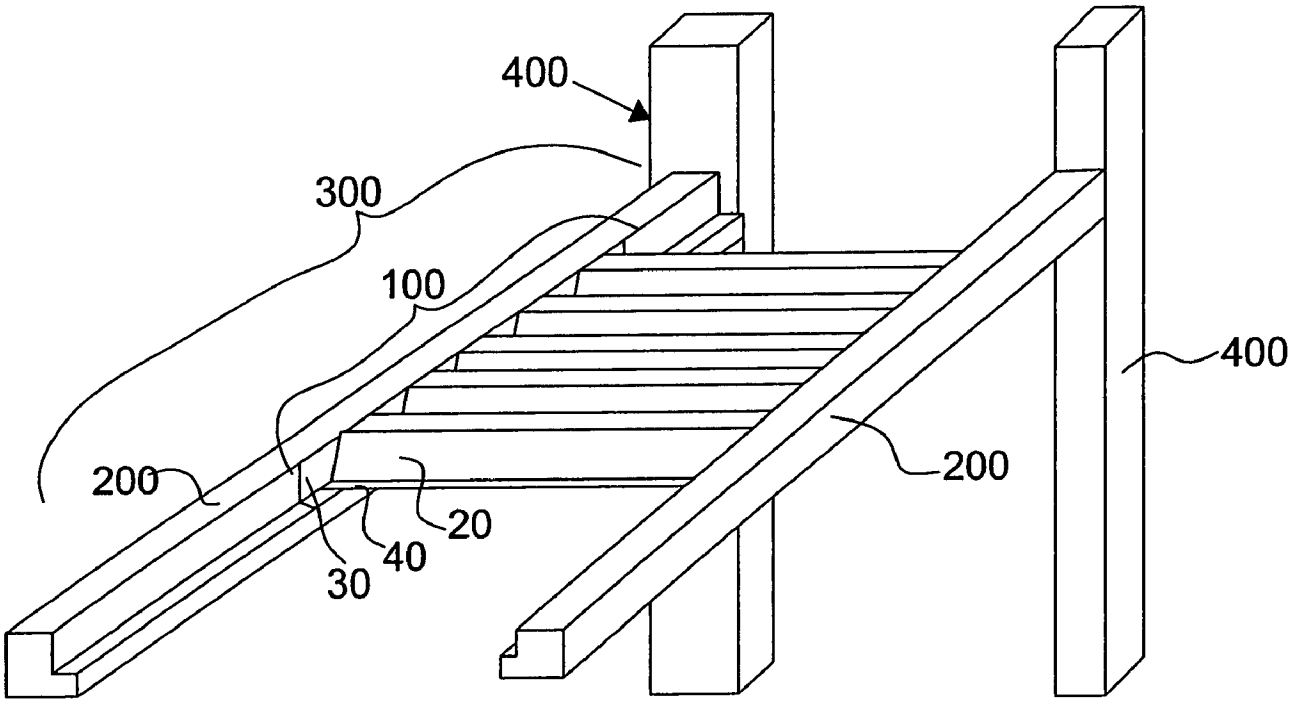
FIG. 8 is a perspective view of the rack beam assembly of FIG. 7.

FIG. 7 is a front view of a rack beam assembly according to an embodiment of the invention incorporating a storage surface assembly according to the invention. The rack beam assembly of FIG. 7 includes a storage surface assembly 100 installed in a set of rack beams 200. The rack beams 200, designed to fit one of many standard commercial/industrial racking systems, may be specified by the user and are well known in the industry. FIG. 8 is a perspective view of the rack beam assembly 300. As shown in FIG. 8, the rack beam assembly 300 may be installed in a commercial/industrial racking system 400.

As evidenced by the numerous traverse member configurations, attachment methods, and grouping/spacing configurations discussed herein, the various embodiments of the invention provide clear advantages over the related art with an easily and inexpensively manufactured and distributed shelving solution that exhibits adequate load bearing capability and structural integrity while still meeting the 50% open area requirement, and which can be easily adapted to meet specific user needs.

The foregoing embodiments and advantages are merely exemplary and are not to be construed as limiting the invention. The present teaching can be readily applied to other types of apparatuses. The description of the invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A storage surface assembly configured for use as a shelf in a racking system, comprising:

a pair of extension members; and a plurality of traverse members extending between the pair of extension members, wherein each of the plurality of traverse members comprises an upper surface, two side surfaces, and an attachment member extending from a lower end of each of the two side surfaces, and wherein ends of each of the plurality of traverse members are configured to be slidably inserted into recesses formed in each of the pair of extension members such that only the attachment members are positioned within corresponding recesses so as to couple the plurality of traverse members to the pair of extension members, wherein at least a portion of the traverse members are spaced apart to form open air spaces therebetween, and wherein the plurality of traverse members form a horizontal surface configured for storage items to be stacked thereon.

2. The assembly of claim 1, wherein the extension members comprise angle irons.

3. The assembly of claim 2, wherein the angle irons are formed at an angle of approximately 90 degrees.

4. The assembly of claim 1, wherein the upper surface and two side surfaces of each traverse member form a hollow interior portion.

5. The assembly of claim 1, wherein a transverse width of an upper portion of each of the traverse members is smaller than a transverse width of a lower portion of the respective traverse member.

6. The assembly of claim 4, wherein each attachment member extends from its respective side surface in a substantially horizontal direction and outward from the hollow interior portion.

7. The assembly of claim 4, wherein each attachment member in a substantially horizontal direction and inward toward a center of the hollow interior portion.

8. The assembly of claim 4, wherein a first attachment member extends from a lower end of a first of the two side surfaces in a substantially horizontal direction and outward from the hollow interior portion, and a second attachment member extends from a lower end of a second of the two side surfaces in a substantially horizontal direction and inward toward a center of the hollow interior portion.

9. The assembly of claim 1, wherein the plurality of traverse members are formed in a plurality of cross sectional shapes.

10. The assembly of claim 1, wherein the recesses formed in each extension member comprise a plurality of notches formed along a longitudinal portion thereof, wherein the plurality of notches are configured to correspond to a cross sectional shape of the ends of the plurality of traverse members.

11. The assembly of claim 10, wherein the ends of the plurality of traverse members are attached to the extension members by snap fit.

12. The assembly of claim 11, wherein each attachment member extends in a substantially horizontal direction and outward with respect to its respective side, and then upward towards the upper surface of the traverse member.

13. The assembly of claim 11, wherein each attachment member extends in a substantially horizontal direction and inward with respect to its respective side, and then upward toward the upper surface of the traverse member.

14. The assembly of claim 11, wherein a first attachment member extends from a lower end of a first side surface of the traverse member in a substantially horizontal direction and outward with respect to its respective side and then upward towards the upper surface of the traverse member, and a second attachment member extends from a lower end of a second side surface of the traverse member in a substantially horizontal direction and inward with respect to its respective side and then upward toward the upper surface of the traverse member.

15. The assembly of claim 1, wherein the ends of the plurality of traverse members are attached to the extension members with a plurality of rivets.

16. The assembly of claim 1, wherein the ends of the plurality of traverse members are attached to the extension members with a plurality of welds.

17. The assembly of claim 1, wherein the ends of the plurality of traverse members are attached to the extension members with a plurality of mechanical fasteners.

18. The assembly of claim 1, wherein a plurality of attachment methods are used to attach the plurality of traverse members to the extension members.

19. The assembly of claim 1, wherein the extension members extend substantially parallel to each other.

20. The assembly of claim 1, wherein the plurality of traverse members extend substantially parallel to each other to form the horizontal surface.

21. The assembly of claim 1, wherein the plurality of traverse members are attached to the extension members at predetermined distances apart so that a horizontal surface area covered by the plurality of traverse members is substantially equal to or less than a horizontal surface area formed by exposed areas between the plurality of traverse members.

22. The assembly of claim 1, wherein the plurality of traverse members attached to the extension members are equally spaced so that a horizontal surface area covered by the plurality of traverse members is substantially equal to or less than a horizontal surface area formed by exposed areas between the plurality of traverse members.

23. The assembly of claim 1, wherein the extension members and traverse members are made from the same material.

24. The assembly of claim 23, wherein the traverse members are made of steel.

25. The assembly of claim 24, wherein the traverse members are made of galvanized steel.

26. The assembly of claim 24, wherein the traverse members are made of stainless steel.

27. The assembly of claim 1, wherein the traverse members are configured to be removed from the extension members and replaced.

28. The assembly of claim 1, wherein at least 50 percent of the horizontal surface between the extension members is open air space.

29. A storage rack comprising the storage surface assembly of claim 1.

30. A storage surface assembly configured for use as a shelf in a racking system, comprising:

a pair of extension members;

a plurality of traverse members, each traverse member comprising at least an upper surface, two side surfaces and further comprising at least one attachment member that extends from a lower end of one of the side surfaces and that is configured to be attached to the extension members; and a plurality of attachment devices configured to attach the at least one attachment member of each of the plurality of traverse members to the extension members such that only the at least one attachment member of the traverse member is engaged by a corresponding attachment device, wherein the plurality of traverse members form a horizontal surface configured for storage items to be stacked thereon.

31. The assembly of claim 30, wherein the extension members comprise angle irons.

32. The assembly of claim 31, wherein the angle irons are formed at an angle of approximately 90 degrees.

33. The assembly of claim 30, wherein the at least one attachment member comprises an attachment member is-provided at a lower end of each of the two side surfaces of each of the plurality of traverse members , and wherein each attachment member extends substantially horizontally and outward with respect to its respective side surface.

34. The assembly of claim 30, wherein the at least one attachment member comprises an attachment member is-provided at a lower end of each of the two side surfaces of each of the plurality of traverse members, and wherein each attachment member extends substantially horizontally and inward with respect to its respective side surface.

35. The assembly of claim 30, wherein the plurality of traverse members each comprise a first attachment member provided at a lower end of a first of one two side surfaces and extending substantially horizontally and outward with respect to its respective side surface, and a second attachment member provided at a lower end of a second of the two side surfaces and extending substantially horizontally and inward with respect to its respective side surface.

36. The assembly of claim 30, wherein the plurality of traverse members are formed in a plurality of cross sectional shapes.

37. The assembly of claim 30, wherein the plurality of attachment devices comprise a plurality of notches formed along a longitudinal portion of each of the extension members, and wherein the plurality of notches are configured to correspond to a cross sectional shape of the ends of the plurality of traverse members.

38. The assembly of claim 30, wherein the ends of the plurality of traverse members are attached to the extension members by snap fit.

39. The assembly of claim 38, wherein an attachment member is provided at a lower end of each of the two side surfaces of each of the plurality of traverse members, and wherein each attachment member extends substantially horizontally and outward with respect to its respective side surface, and then upward toward the upper surface of the traverse member.

40. The assembly of claim 38, wherein the at least one attachment member comprises an attachment member is-provided at a lower end of each of the two side surfaces of each of the plurality of traverse members, and wherein each attachment member extends substantially horizontally and inward with respect to its respective side surface, and then upward toward the upper surface of the traverse member.

41. The assembly of claim 38, wherein the plurality of traverse members each comprise a first attachment member provided at a lower end of a first of one two side surfaces and extending substantially horizontally and outward with respect to its respective side surface and then upward toward the upper surface of the traverse member, and a second attachment member provided at a lower end of a second of the two side surfaces and extending substantially horizontally and inward with respect to its respective side surface and then upward toward the upper surface of the traverse member.

42. The assembly of claim 38, wherein the plurality of traverse members are formed in a plurality of cross sectional shapes.

43. The assembly of claim 30, wherein a transverse width of an upper portion of each of the traverse members is smaller than a transverse width of a lower portion of the respective traverse member.

44. The assembly of claim 30, wherein the attachment device comprises a rivet configured to attach the at least one attachment member portion of each of the plurality of traverse members to the extension members.

45. The assembly of claim 30, wherein attachment device comprises a spot weld configured to attach the at least one attachment member portion of each of the plurality of traverse members to the extension members.

46. The assembly of claim 30, wherein the attachment device comprises a bolt configured to attach the at least one attachment member portion of each of the plurality of traverse members to the extension members.

47. The assembly of claim 30, wherein the extension members extend substantially parallel to one another.

48. The assembly of claim 30, wherein the traverse members extend substantially parallel to one another.

49. The assembly of claim 30, wherein the plurality of traverse members are attached to the extension members at predetermined distances apart so that a horizontal surface area formed by the plurality of traverse members is substantially equal to or less than a horizontal surface area formed by exposed areas between the plurality of traverse members.

50. The assembly of claim 30, wherein the plurality of traverse members attached to the extension members are equally spaced so that a horizontal surface area formed by the plurality of traverse members is substantially equal to or less than a horizontal surface area formed by exposed areas between the plurality of traverse members.

51. The assembly of claim 30, wherein the extension members and traverse members are made from the same material.

52. The assembly of claim 51, wherein the traverse members are made of steel.

53. The assembly of claim 52, wherein the traverse members are made of galvanized steel.

54. The assembly of claim 52, wherein the traverse members are made of stainless steel.

55. The assembly of claim 30, wherein the traverse members are configured to be removed from the extension members and replaced.

56. A storage rack comprising the storage surface assembly of claim 30.

57. The assembly of claim 1, wherein only the attachment surfaces and a portion of the corresponding side surfaces contact the respective extension member.

58. The assembly of claim 1, wherein only the attachment surfaces contact the respective extension member.

59. The assembly of claim 30, wherein only the at least one attachment member and only a portion of a corresponding side surface of the traverse member contacts the extension member.

60. The assembly of claim 30, wherein each traverse member is configured to stand on and be supported by its at least one attachment member.

61. The assembly of claim 30, wherein only the at least one attachment member portion of the traverse member contacts the respective extension member.

62. The assembly of claim 1, wherein the traverse members limit movement of the extension members with respect to each other.

63. The assembly of claim 1, wherein the traverse members hold the extension members parallel to each other.

64. The assembly of claim 1, wherein the traverse members prevent the extension members from moving in the longitudinal direction of the traverse members.

* * * * *